US005772538A

United States Patent [19]

Sztykiel et al.

[11] Patent Number: 5,772,538

[45] Date of Patent: Jun. 30, 1998

[54] FREE STANDING GOAL BARRIER APPARATUS

[76] Inventors: John Sztykiel, 6040 Stoney Pointe Dr., Lansing, Mich. 48917; Michael Huhn, 9365 Grove Rd., DeWitt, Mich. 48820

[21] Appl. No.: 886,108

[22] Filed: Jun. 30, 1997

[51] Int. Cl.[6] ..... A63B 69/00

[52] U.S. Cl. ..... 473/446; 473/471

[58] Field of Search ..... 473/446, 448, 473/471, 478

[56] References Cited

U.S. PATENT DOCUMENTS

| | | | |
|---|---|---|---|
| 3,675,921 | 7/1972 | Meyers Sr. | 473/448 |
| 3,765,675 | 10/1973 | Di Marzio | 473/446 |
| 3,840,228 | 10/1974 | Greaney | 473/446 |
| 3,856,298 | 12/1974 | Frantti | 473/446 |
| 3,887,181 | 6/1975 | Samaras | 473/446 |
| 4,168,062 | 9/1979 | McCarthy et al. | 473/446 |
| 4,489,940 | 12/1984 | Amundson | 473/446 |
| 4,989,862 | 2/1991 | Curtis | 473/448 |
| 5,238,243 | 8/1993 | Grispi | 473/446 |
| 5,465,958 | 11/1995 | Brun | 473/446 X |
| 5,498,000 | 3/1996 | Cuneo | 473/471 |
| 5,509,650 | 4/1996 | MacDonald | 473/446 |
| 5,509,652 | 4/1996 | Woronets | 473/446 |
| 5,527,185 | 6/1996 | Davis | 434/248 |
| 5,582,404 | 12/1996 | Parzino | 473/446 |
| 5,584,481 | 12/1996 | Caluori et al. | 473/446 |

*Primary Examiner*—William H. Grieb
*Attorney, Agent, or Firm*—Knechtel, Demeur & Samlan

[57] ABSTRACT

A free-standing goal tending apparatus permitting unlimited planar adjustments of the upper and lower limb joints is presented. The joints pivotally rotate about axis points. Slots found in the preselected joints allow pivotal and sliding adjustments. The goal tending figure is affixed to a frame which allows height adjustments to keep both feet of the apparatus on the ground and is collapsible for storage or transport. Also provided is a base having a lower surface which permits forward movement of the device yet keeps it from moving backward when struck by a puck or other playing piece and wheels for movement.

27 Claims, 4 Drawing Sheets

FREE STANDING GOAL BARRIER APPARATUS

I. FIELD OF THE INVENTION

The present invention relates to an apparatus for improving the shot placement of a hockey player and, more particularly, to a free-standing goalie apparatus which permits unlimited planar adjustments of the hands, shoulders, hips, knees, and ankles, while at the same time permits the foot portion of the device to remain in contact with the surface, thereby creating realistic goalie positioning. The apparatus further provides a frame mounted to a base, the frame being height adjustable, able to withstand being struck with a puck, and collapsible for storage or transport. The base has wheels and a bottom surface which maintains position on the surface while causing minimal disruption of the surface.

II. BACKGROUND OF THE INVENTION AND PRIOR ART

Accurate shot taking is critical to hockey players. Players practice endlessly to improve their goal scoring capabilities. Ideally, practice is done with a live goalie in the net. However, in many instances this is impractical. For those times when a live goalie is not available, a suitable alternative is necessary. To this end, several devices have been developed which provide obstacles to propelling a puck into a goal.

U.S. Pat. No. 3,840,228 to Greaney discloses a V-shaped (when viewed from above) planar impact resistant panel which is affixed to a goal via mounting mechanisms. This device has a perimeter which obliterates a major portion of the goal opening, thereby forcing the shot taker to direct his shot to that space found between the edge of the device and the goal post. The device also has a hole between the goalie's legs for shot taking. There are several shortcomings to this device. First, it is permanently affixed to the goal and cannot, therefore, be maneuvered into alternative positions commonly encountered by a hockey player. Second, the device does not permit movement of the limbs, making the device unsuitable for players wanting to practice different positions that may be presented by a live goalie. Third, the device has fixed, limited areas for successful shot placement, thus, the difficulty in placing successful shots may affect a player's confidence.

U.S. Pat. No. 5,238,243 to Grispy teaches a planar device which affixes to the frame of a goal opening, thereby covering essentially the entire opening. The device has a goalie figure embossed onto it and further teaches strategically placed holes through which a hockey player must direct a shot for a successful score. This device suffers from the same shortcomings as does the Greaney patent, with the additional shortcoming that this is strictly a two-dimensional device laying flat against the goal opening, thereby providing no target when a hockey player is attempting to shoot from any position away from the front of the net.

A similar device is seen in U.S. Pat. No. 5,509,650 to McDonald. In this device, however, the entire device is supported by brackets which rest on the ground surface. This device contains the additional feature of alternating lights which direct the player to shoot toward a designated hole.

A moveable structure having pivotally connected arms is seen in U.S. Pat. No. 4,168,062 to McCarthy. This device teaches an automated machine which can be positioned on the ice or other surface, and when activated, moves its arms to various positions, thereby creating different situations for a hockey player. The shortcoming of this device is that due to its configuration, i.e. having the mechanical features behind and to the lower aspect of the goalie shaped figure, it does not permit articulation and movement of the lower limbs.

Movement of the lower limbs is critical to effective shot practice. The inventors have noted that most shots blocked by a goalie are done so using the lower limbs. Crouching, outstretched legs, etc. are all situations that a goalie may give an approaching player. Therefore, a training device not permitting movement of a goalie's lower limbs does not provide a sufficiently realistic look for a player to practice shot taking.

There is need, therefore, for an inexpensive, easy-to-use goalie simulating apparatus which permits unlimited placement to simulate the positioning of a live goalie. There is further need for such an apparatus which permits unlimited planar adjustment of the goalie's hands, shoulders, hips, knees and ankles, yet keeps the apparatus' feet in contact with the surface. Additionally, there is need for a goalie simulating apparatus which is attached to a sufficiently sturdy support system that it can withstand the impact of a puck yet can be collapsed for storage or transport. There is further need for a goalie simulating apparatus having a base which creates sufficient friction with the ground surface such that there is only minimal movement of the device when impacted with a puck, yet causes minimal disruption of the surface itself

II. OBJECTS OF THE INVENTION

It is, therefore, an object of this invention to provide a free-standing, three-dimensional goal tending apparatus for use in hockey or other net games.

It is a further object of the present invention to provide a goal tending apparatus which simulates the look of a live goalie by permitting adjustments at the apparatus' hands, shoulders, hips, knees, and ankles, as well as height adjustments which keep the goalie's feet touching the ground by compensating for the lower limb adjustments.

It is a further object of the present invention to provide a goal tending apparatus in which the lower limbs may be adjusted to simulate, along a planar axis, the flexion of a live goalie's hips and knees.

It is a further object of the present invention to provide a goal tending apparatus which can be used on any surface, such as ice, asphalt, wood, etc.

It is a further object of the present invention to provide a goal tending apparatus which, while being free-standing, has a support platform which creates friction with the surface, yet can move forward and backward with minimal disruption of the ground or ice surface.

It is a further object of the present invention to provide a goal tending apparatus which has a frame that can be adjusted for height and can withstand the impact of a puck against the goalie figure without collapsing.

It is yet a further object of the present invention to provide a goal tending apparatus having a roller assembly for ease of movement.

It is a another object of the present invention to provide a goal tending apparatus which can be folded flat for storage or transfer.

IV. SUMMARY OF THE INVENTION

The present invention provides a goalie simulating apparatus for use by net game players in perfecting their shot taking ability. According to the invention, there is a two-dimensional figure in the shape of a goalie. The goalie is adjustable at the hands, shoulders, hips, knees and ankles. Slots found near the knee area allow adjustment simulating the flexion of a live goalie's lower limbs. The slots further allow adjustment when both legs are not identically positioned, thus permitting both feet to touch the ground. The two-dimensional figure is affixed to a height adjustable frame. When the goalie's hips, knees and ankles are adjusted to the desired position, the height of the goalie apparatus can also be adjusted so that the goalie's feet are touching the ground, thereby creating a more realistic shooting target. The frame, in turn, is affixed to a base, the base having a smooth upper surface and a toothed under surface. The teeth of the under surface are angled to the rear of the device, so that when the device is moved in a forward direction, it slides easily along the ground surface; however, when backward movement is attempted, the teeth bite into the ground surface. Thus, backwards movement of the apparatus when struck with a playing piece, such as a puck or ball, is minimal. The base also has a wheel assembly affixed to it which assists in moving the inventive device. Finally, the goalie figure, frame and base can be folded flat for storage or transfer.

V. BRIEF DESCRIPTION OF THE DRAWINGS

VI. DESCRIPTION OF THE PREFERRED EMBODIMENT

The description of the preferred embodiment uses figures depicting an ice hockey goalie. It should be understood, however, that the device may be manufactured for use in any setting in which a goalie is used, for example, soccer, field hockey, in-line skate hockey, and lacrosse.

Figure 1:
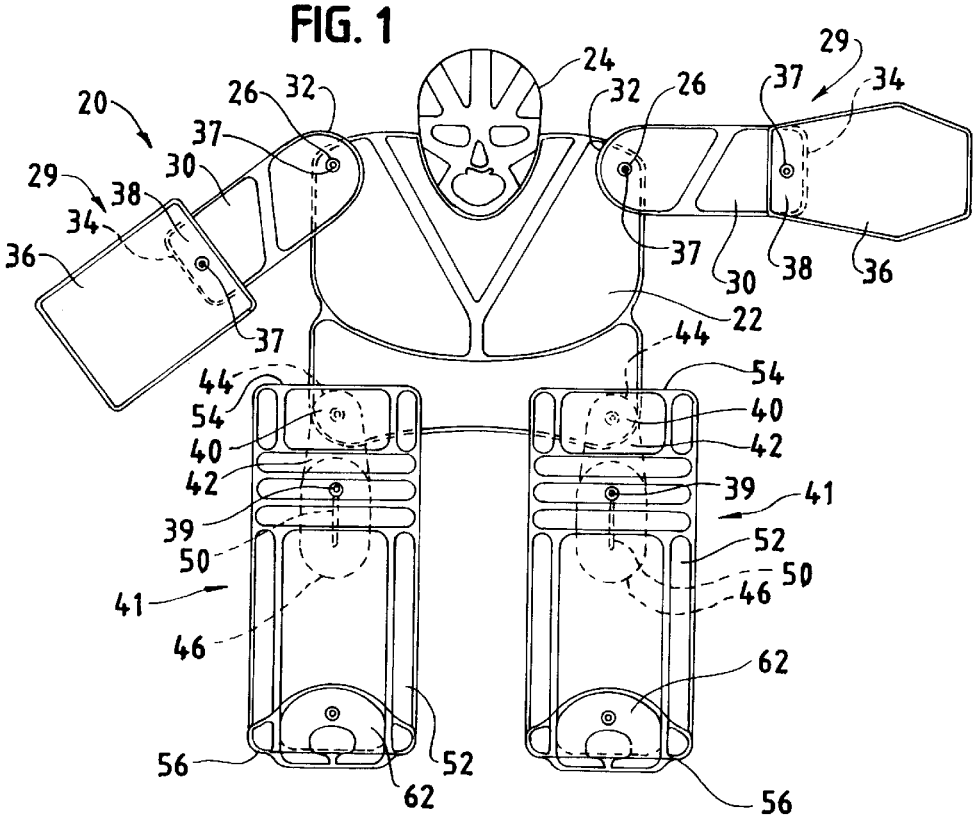
FIG. 1 depicts a front view of the goalie figure unattached to the frame.

Turning to the Figures, FIG. 1 depicts a front view of a goalie FIG. 20 not attached to a frame or a base. Torso 22 of the goalie FIG. 20 has a head 24 permanently affixed to its upper edge. At a point on torso 22 near the point where a shoulder is found on a live human being are found shoulder pivots 26. Upper limb 29 is pivotally attached to torso 22 at shoulder pivot 26. Upper limb 29 has two sections: upper arm 30 and lower arm 36. Upper arm 30 has two ends, shoulder end 32 and an wrist end 34. Upper arm shoulder end 32 is pivotally affixed to torso 22 at shoulder pivot 26. Lower arm 36 is pivotally attached to upper arm wrist end 34 at wrist pivot 38. The attachment means 37 used to affix arm 30 at shoulder pivot 26 and lower arm 36 to upper arm wrist end 34 at wrist pivot 38 can be by any conventional means. The inventors have found, however, that a carriage bolt with a reversibly self-locking threaded knob works best. A knob is most efficient in that it requires no additional tools to sufficiently tighten or loosen for upper arm position changes. The knob is tightened down to affix and hold the joint in a selected position. The inventors have also found that having a two section upper limb is preferred over a three section upper limb (which would simulate an upper arm, lower arm and hand). The additional benefits derived from having a third section to manipulate are not sufficient to overcome the weakness caused by a third section and the increased cost in supplying a third section. This is particularly true when considering the fact that most live goalies wear protective gear that covers both hand and a portion of the lower area. A third section can, however, be added without exceeding the scope and spirit of the present invention.

Figure 8:
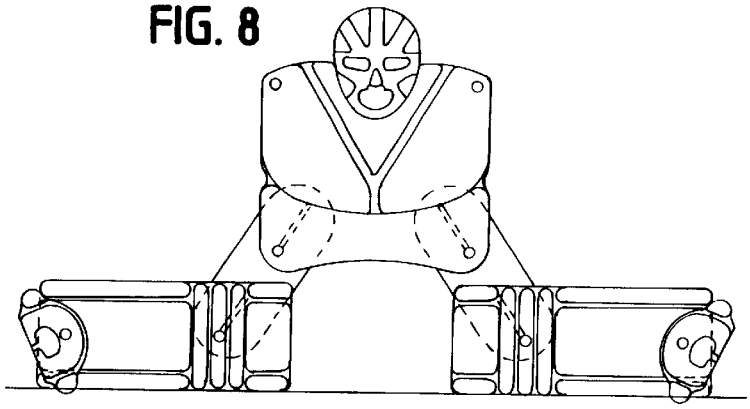
Figure 9:
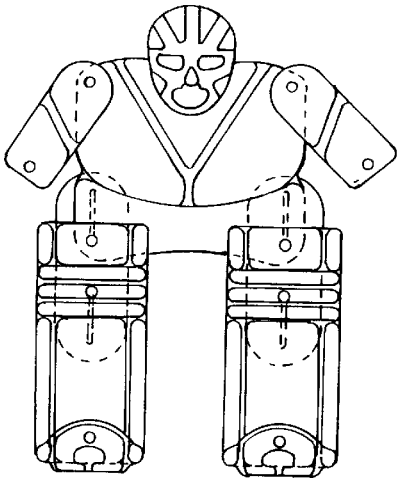
Figure 10:
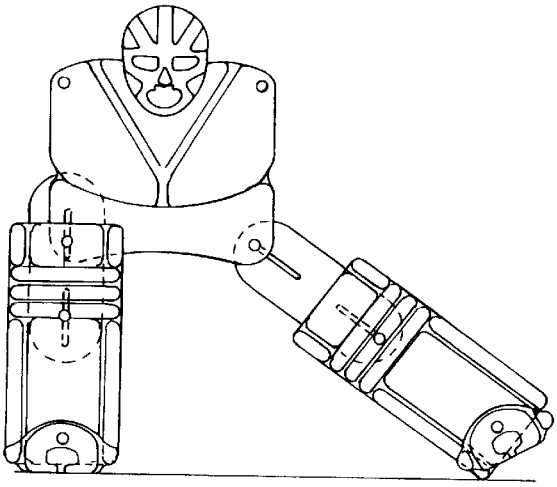
Figure 11:
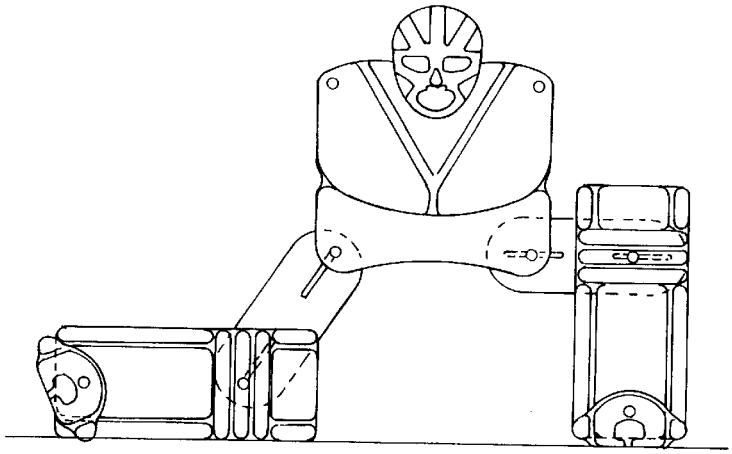
Figure 12:
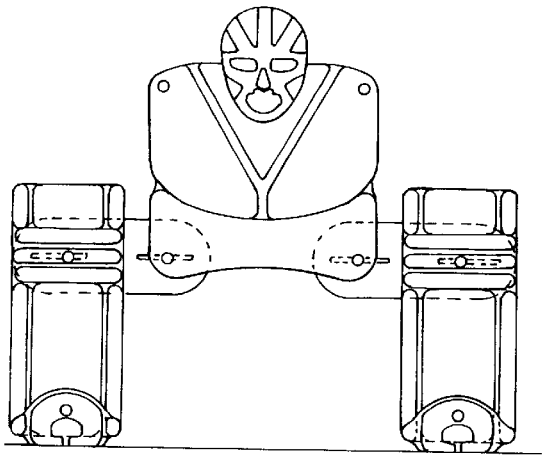
Figure 13:
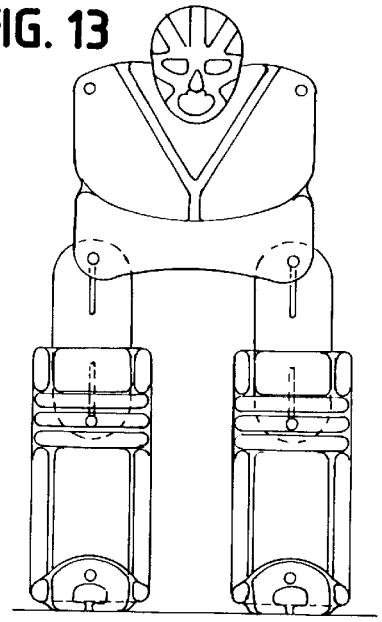
Figure 14:
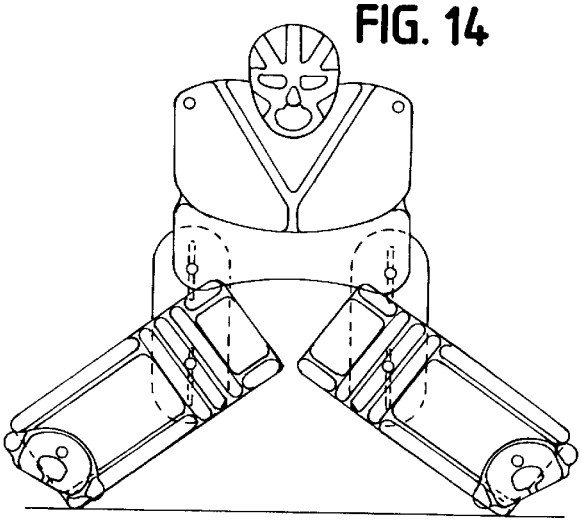
Figure 15:
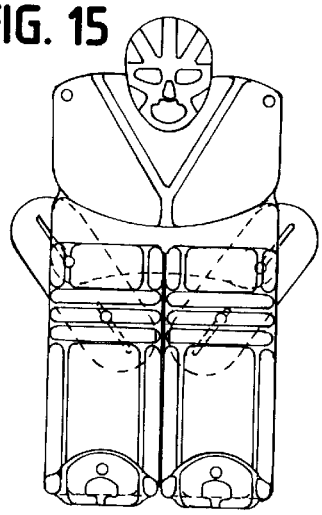
Figure 16:
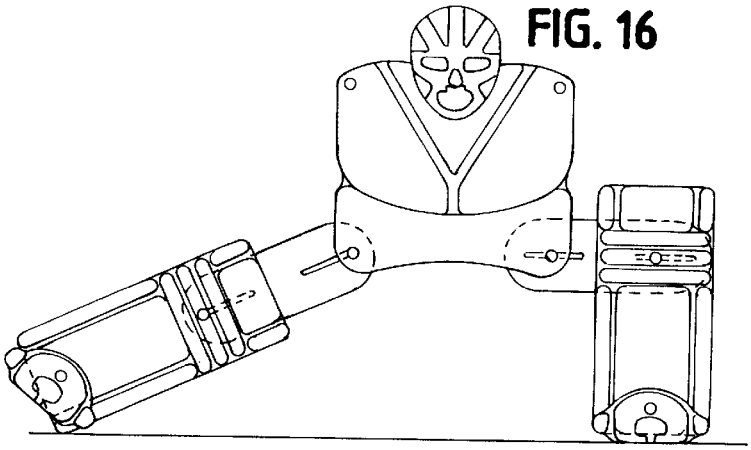

Also found on torso 22 near the area of a hip on a human being is found hip pivot 40. Lower limb 41 is pivotally attached to torso 22 at hip pivot 40. Lower limb 41 has three sections: upper leg 42, lower leg 52, and foot 62. Upper leg 42 has two ends, hip end 44 and knee end 46. Hip end 44 is pivotally attached to torso 22 at hip pivot 40. Knee end 46 has a slot 50 which extends approximately one third the length of upper leg 42. Affixed to knee slot 50 is lower leg 52. Lower leg 52 has two ends, lower leg knee end 54 and lower leg ankle end 56. Lower leg knee end 54 is pivotally attached to upper leg knee end 46 at slot 50 and able to slide along slot 50. Lower leg 52 is affixed via fastening means as used at shoulder pivot 26, wrist pivot 38 and hip pivot 40. Knee slot 50 is between one-quarter and one-half the length of upper leg 42 with a one-third length being preferred. Knee slot 50 is of sufficient width to accept attachment means 39 without permitting undue side-to-side movement. Knee slot 50 permits not only pivotal articulation of the joints, but also sliding movement along the length of the slot. Turning to FIG. 8, it can be seen that such movement is critical inasmuch as, for example, when one lower limb 58 is in a vertical position and the opposite limb 60 is in an angled position, movement in knee slot 50 is required in limb 58 in order to keep limb 60 on the ground. See FIGS. 9 and 14 for further examples. Without such sliding movement along the knee slot 50, both legs of goalie FIG. 20 would not simultaneously touch the ground in any position other than when both legs are identically positioned. This feature is critical to the invention, inasmuch as goals can be scored in hockey and other net games should a puck or other playing piece be propelled under the goalie's legs.

Slot 50 is also critical in various positions in which the goalie's legs are symmetrically positioned, as seen in FIGS. 7, 8, 9, 10, 13, 15, and 16. Movement along the knee slot 50 mimics the forward flexion of the knees and hips of a live goalie along a single plane. Accordingly, goalie FIG. 20 can be positioned in unlimited planar positions along a single axis yet present a view to an oncoming hockey player of a three dimensional goalie in a realistic position setting.

Alternatively, slots may also be utilized in any of the articulating joints. The inventors have found, however, that slotted joints in the upper limbs do not yield realistic positioning of the upper limbs. Slotted hip joints may be advantageous in some settings, but do not significantly increase the realistic look of a slotted knee joint. The advantages gained by slotting a joint must be weighed against the strength lost when removing material from a particular piece.

Also, the slots may be placed in alternate pieces. A non-limiting example is that the knee slot may be placed in the lower leg knee end as opposed to the upper leg knee end or inserted in both the upper leg knee end and the lower leg knee end. Such configurations can be utilized at any articulated joint and are fully contemplated by the inventors. Strength, cost and aesthetic considerations make slots in the upper leg knee end the preferred embodiment.

Affixed to lower leg ankle end 56 is foot 62. Foot 62 is rotationally affixed at lower leg ankle pivot 56 by the same means as is the other articulated joints. Foot 62 can be moved into positions which create realistic views of the angles created by a goalie's feet. This adds additional realism to the position of goalie FIG. 20.

Figure 2:
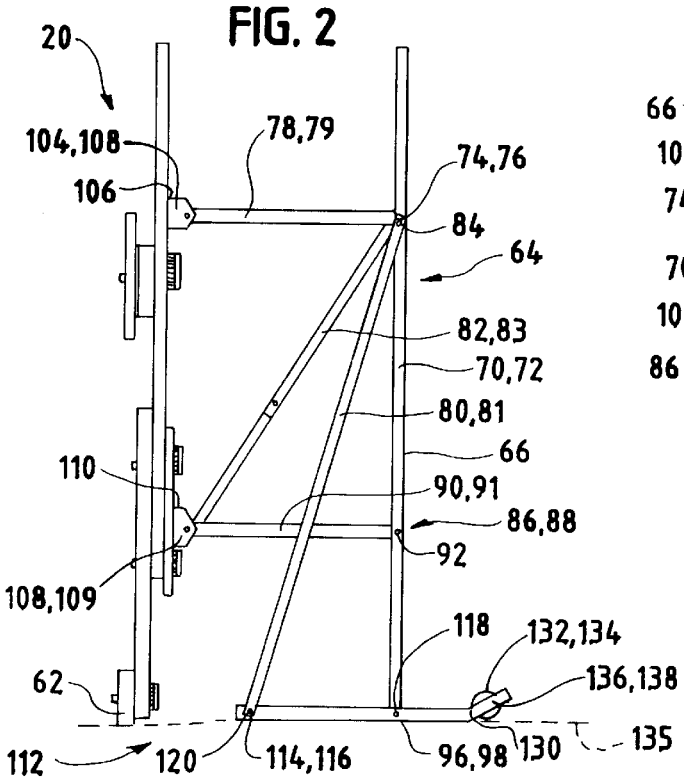
FIG. 2 depicts a right side view of the device illustrating the frame.

Referring to FIG. 2, a side view of goalie FIG. 20 attached to frame 64 is depicted. Frame 64 is uniquely designed to allow height adjustments of goalie FIG. 20 so that after the lower limbs have been adjusted to desired positions, height adjustments can be made which permit feet 62 to come in contact with the surface. Additionally, frame 64 is uniquely designed in that it can be collapsed while still attached to goalie FIG. 20 to an essentially flat configuration for transport or storage.

Figure 3:
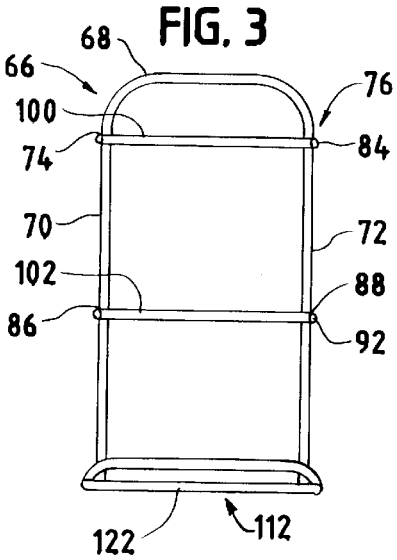
FIG. 3 depicts a front view of the frame and base only.
Figure 4:
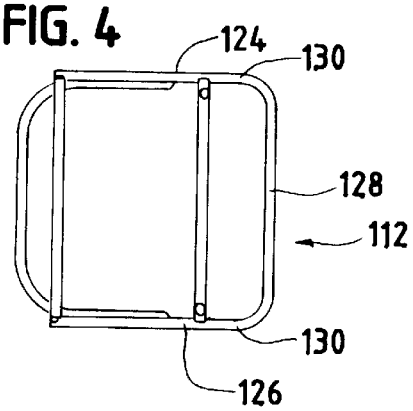
FIG. 4 depicts a top view of the frame and base only.

Frame 64 has a vertical U-shaped frame support member 66 (more clearly seen in FIG. 3). Vertical U-shaped frame support member 66 further comprises upper cross member 68 and vertical lengths 70, 72. At a predetermined point on vertical lengths 70, 72 near upper cross member 68 are found upper pivot points 74, 76. Connected to each upper pivot point is an upper support member 78, 79 and angled support member 80, 81, and a height adjustment means 82, 83. These parts are secured to vertical lengths 70, 72 at upper pivot point 74, 76 by means of upper pivot pin 84. Upper pivot pin 84 extends from upper pivot point 74 to upper pivot point 76 and may be secured using any conventional means, such as cotter pin, locking end cap, or washer and nut configuration.

Also located on vertical lengths 70, 72 at approximately ⅔ of the length as measured from upper cross members 78, 79 are found middle pivot points 86, 88. Attached to each middle pivot point 86, 88 are lower support members 90, 91. Lower support members 90, 91 are attached to middle pivot points 86, 88 by middle pivot pin 92. Middle pivot pin 92 extends from middle pivot point 86 to middle pivot point 88 and is secured in the same manner as upper pivot point pin 84. Covering upper pivot pin 84 and lower pivot pin 92 is upper cross support member sheath 100 (on upper pivot point pin 84) and lower cross support member sheath 102 (on lower pivot point pin 92). The cross support member sheathes provide additional strength to a frame.

Upper support members 78,79 are pivotally attached at their opposite ends to upper support member pivot brackets 104, 105. Upper support member pivot brackets 104, 105 are, in turn, attached to the rear of the upper portion of torso 22 at 106. The opposite end of lower support members 90, 91 and the opposite end of height adjustment means 82, 83 are pivotally affixed to lower support members pivot members 108, 109. Lower support member pivot brackets 108, 109 are affixed to the lower aspect of the rear of torso 22 at 110.

Frame 64 is pivotally attached to base 112 at two points: the lower aspect of vertical lengths 70, 72 at lower pivot points 96, 98 respectively, and at the lower aspect of angled support members 80, 81 at base front pivot points 114, 116. Vertical lengths 70, 72 and angled support members 80, 81 are pivotally attached to base 112 through lower pivot pin 118 and base front pivot pin 120 in the same fashion as upper support members 78, 79 and lower support members 90, 91. Extending from base front pivot point 114 to base front pivot point 116 is base cross support member sheath 122.

Figure 5:
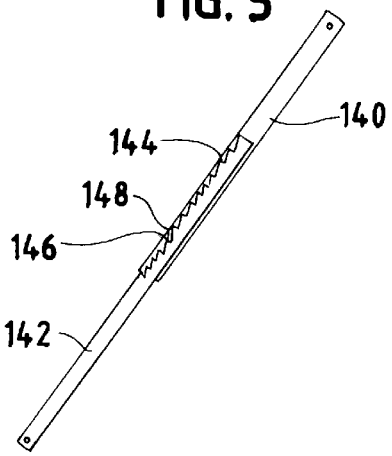
FIG. 5 depicts a close-up cutaway view of the height adjustment means.
Figure 6:
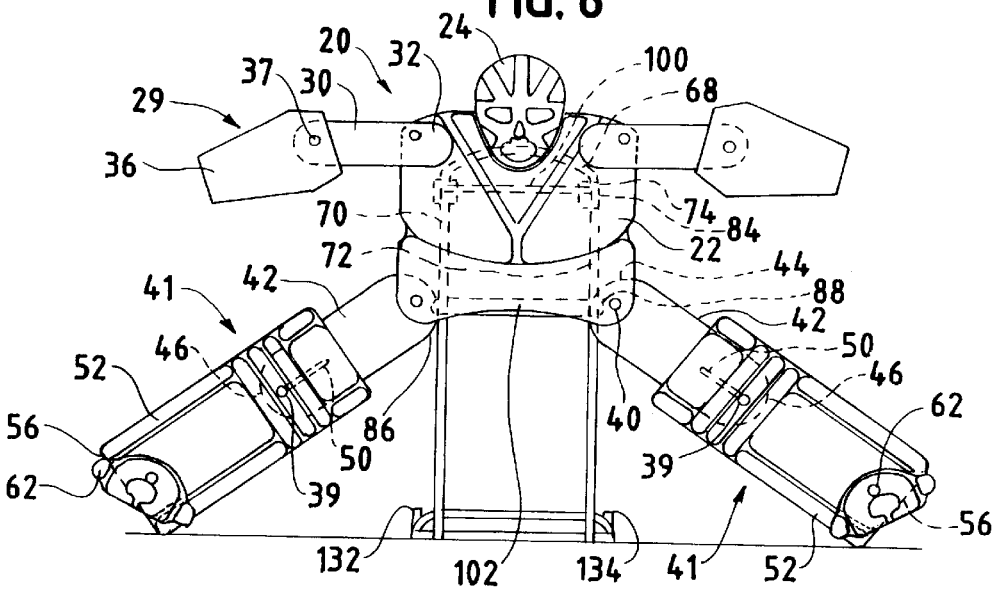
FIG. 6 depicts a front view of the goalie figure attached to a frame.
Figure 7:
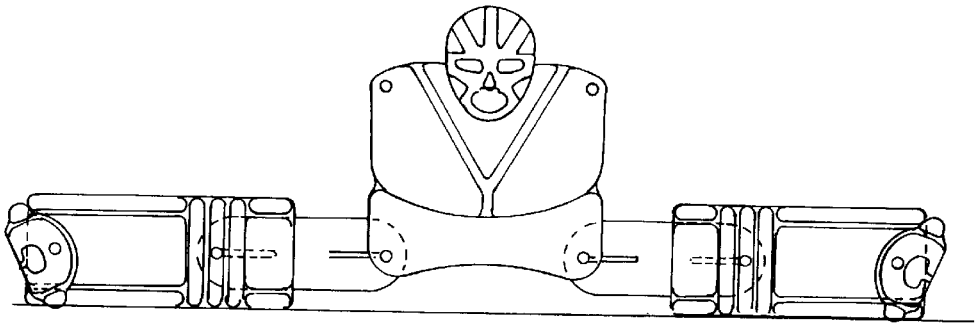
FIGS. 7 through 16 are representative examples of possible lower limb positions.

Base 112 is essentially a U-shaped piece having two horizontal lengths 124, 126 co-formed with base cross member 128. Horizontal lengths 124, 126 are angled at 130 in upward fashion, thereby lifting base cross member 128 off the surface. Attached to horizontal lengths 124, 126 to the rear of angle 130 are found wheels 132, 134 which are rotatably affixed using wheel pins 136, 138. When frame 64 is in a locked, upright position, wheels 132, 134 do not touch the ground. When movement of the device is necessary, it can be tipped backwards so that wheels 132, 134 come in contact with the surface and base horizontal lengths 124, 126 are raised from the surface, thereby allowing the device to be rolled to a desired location. Affixed to the bottom of base 112 is a means for creating friction with the surface 135. Means for creating friction comprises a plurality of essentially downwardly projecting teeth 137 which are angled to the rear of the base at a sufficient angle that when a puck or other propelled object strikes goalie FIG. 20, teeth 137 bite into the surface. Yet, when it is desirable to move the apparatus forward, teeth 137 will disengage the surface. Teeth 137 should be of a sufficient length that they bite into the surface when moved in a rearward direction, but not be so long that they either are difficult to disengage or cause more than minimal disruption of the surface. Turning to FIG. 5, it can be seen that height adjustment means 82, 83 are two-piece members comprising a height adjustment means upper section 140 and a height adjustment means lower section 142. Height adjustment member upper section 140 is sized so that it fits within the circumference of height adjustment member lower section 142. Height adjustment member upper section 140 has large downwardly projected serrations 144 formed into it. As height adjustment member upper section 140 is slid into height adjustment member lower section 142, the serrations 144 of height adjustment member upper section 140 come into alignment with height adjustment hole 146. Height adjustment pin 148 is then inserted into height adjustment hole 146 through serration 144. In this fashion, the length of height adjustment means 82, 83 is determined. Alternatively, height adjustment means 82, 83 could consist of a compression fitting or other conventional locking mechanism. The spirit of the invention is embodied in the fact that height adjustment means 82, 83 is length adjustable.

In operation, positional adjustments are made to the articulated joints of the upper limbs and lower limbs by positioning them at their pivot points and tightening the attachment means. For those articulated joints incorporating a slot, additional adjustment can be made by not only pivotally rotating the articulated joint, but also by sliding the attachment means through the length of the slot and then tightening the attachment means. Once the upper and lower limbs are in the desired positions, the height of the fully FIG. 20 can be adjusted via height adjustment means 82, 83. For example, if after positioning the lower limbs of goalie FIG. 20, feet 62 are not in contact with the ground, height adjustment means 82, 83 can be lengthened by removing height adjustment means pin 148, thereby allowing height adjustment means 82, 83 to be lengthened by moving height adjustment means upper section 140 the necessary distance out from height adjustment means lower section 142, and re-inserting height adjustment means pin 148. Due to the unique design of frame 64, while the length of height adjustment means 82 is being adjusted, upper support members 78, 79 pivot about upper pivot points 74, 76 and upper support member pivot brackets 104, 105, and lower support members 90, 91 pivot about middle pivot points 86, 88 and lower support member pivot brackets 108, 109 in a downwardly fashion. Angled support members 80, 81, however, maintain their position. Thus, once the height of goalie FIG. 20 is lowered, the feet 62 of goalie FIG. 20 are touching the surface. This is a significant advancement over the current art.

Also due to the unique configuration of frame 64, it is possible to collapse the frame for storage or transport by lengthening height adjustment means 82, 83 to their fall extent, thereby causing upper support members 78, 79 and lower support members 90, 91 to drop to a near vertical position. Base cross member 128 is then lifted in an upwardly fashion, thereby causing angled support members 80, 81 also to fold into a near vertical position along vertical lengths 70, 72 of vertical U-shaped frame support member 66. These movements position the device into a near flat position suitable for storage or transport.

While there has been disclosed what is at present considered to be the preferred embodiment of the invention, it will be understood that various modifications may be made therein and it is intended to cover in the appended claims all such modifications as fall within the true scope and spirit of the invention.

We claim:

1. A free standing goalie apparatus comprising:

a torso;

two upper limbs, each upper limb further having an upper arm section and a lower arm section, the upper arm section having a shoulder end and a wrist end, the shoulder end being pivotally affixed to the torso and the wrist end being pivotally affixed to the lower arm section;

two lower limbs, each lower limb having an upper leg section, a lower leg section, and a foot section, the upper leg section further having an upper pivot point and a lower pivot slot, the upper leg section being pivotally affixed at its upper pivot point to the torso, and to the lower leg section at its lower pivot slot, and the foot section being pivotally affixed to the lower leg section;

a frame, the frame being affixed to the back of the torso; and, a base attached to the frame.

2. The free standing goalie of claim 1 wherein the lower pivot slot is between ¼ and ½ the length of the upper section.

3. The lower pivot slot of claim 2 being ⅓ the length of the upper section.

4. The free standing goalie of claim 1 wherein the lower pivot slot permits sliding adjustment along its length and pivotal adjustment about means for attaching lower leg section to upper leg section.

5. The free standing goalie of claim 1 wherein the frame is height adjustable.

6. The free standing goalie of claim 1 wherein the frame is collapsible.

7. The free standing goalie apparatus of claim 1 wherein the base further comprises means for creating friction with the surface.

8. The means for creating friction of claim 7 further comprising a plurality of downward projecting teeth which are angled toward the rear of the base.

9. The free standing goalie of claim 1 wherein the base further comprises means for transporting.

10. The means for transporting the goalie apparatus of claim 9 comprising wheels.

11. The free standing goalie of claim 1 wherein the upper limbs further comprise a middle section having two ends, one end pivotally affixing to the wrist end of the upper arm section and its opposite end pivotally affixing to the lower arm section.

12. The free standing goalie apparatus of claim 1 wherein the torso, legs, arms, and hands are shaped to simulate an ice hockey goalie.

13. The free standing goalie apparatus of claim 1 wherein the torso, legs, arms, and hands are shaped to simulate a field hockey goalie.

14. The free standing goalie apparatus of claim 1 wherein the torso, legs, arms, and hands are shaped to simulate a soccer goalie.

15. The free standing goalie apparatus of claim 1 wherein the torso, legs, arms, and hands are shaped to simulate a lacrosse goalie.

16. The free standing goalie apparatus of claim 1 wherein the torso, legs, arms, and hands are shaped to simulate an in-line skate hockey goalie.

17. The free standing goalie apparatus of claim 1 wherein the frame further comprises a vertical frame support member, at least one upper support member, at least one lower support member, at least one angled support member, and at least one height adjustment means, wherein one end of the upper support member, angled support member, and height adjustment means are pivotally affixed to an upper pivot point of the vertical frame support member and the opposite end of upper support member is pivotally affixed to an upper support member pivot bracket, said bracket being affixed to the torso on its back side, the opposite end of the angled support member being pivotally affixed to a base front pivot point, and the opposite end of the height adjustment means being pivotally affixed to a lower support member pivot bracket, said bracket being affixed to the torso on its back side, one end of the lower support member being pivotally affixed to the vertical frame support member at a middle pivot point, and the opposite end of the lower support member being pivotally affixed to the lower support member pivot bracket, and the vertical frame support member being pivotally affixed at its lower end to a lower pivot point of a base.

18. The frame of claim 7 wherein the height adjustable frame has an upper section and a lower section, the upper section is sized to fit within the diameter of the lower section, and is held in place by locking means.

19. A free standing goalie apparatus comprising:

A torso, two upper limbs, and two lower limbs, the upper limb having fully articulating shoulder and wrist joints and the lower limb having fully articulating hip, knee, and ankle joints, wherein preselected articulated joints also include slots permitting both sliding and pivotal adjustment of the preselected joints;

a frame having a base, the frame being affixed to the torso.

20. The free standing goalie of claim 19 wherein the upper limb includes an articulated elbow.

21. The free standing goalie of claim 19 wherein the frame is height adjustable.

22. The free standing goalie of claim 19 wherein the frame is collapsible.

23. The free standing goalie of claim 19 wherein the base includes means for creating friction with a surface.

24. The base of claim 23 wherein the means for creating friction with a surface comprises a plurality of generally downwardly projecting and rearwardly angled teeth.

25. The free standing goalie apparatus of claim 19 wherein the base further comprises means for transporting the apparatus.

26. The means for transporting the apparatus of claim 25 further comprising wheels.

27. A method for positioning a free standing goalie apparatus having articulated joints, including at least two slotted articulated joints, securing means, and a height adjustable and collapsible frame, comprising the steps of:

manipulating the frame to place the goalie apparatus in a standing position from a collapsed position;

positioning the slotted articulated joints by pivotally rotating and sliding the joint about the slots and securing them with the securing means; and, positioning the articulated joints containing and securing them with the securing means.

* * * * *